US006776290B2

(12) United States Patent
Augustine

(10) Patent No.: US 6,776,290 B2
(45) Date of Patent: Aug. 17, 2004

(54) ARTICLE CONTAINER AND DISPLAY DEVICE

(76) Inventor: Jeffery W. Augustine, 2840 Hwy. 457, Alexandria, LA (US) 71302

( * ) Notice: Subject to any disclaimer, the term of this patent is extended or adjusted under 35 U.S.C. 154(b) by 117 days.

(21) Appl. No.: 10/071,327

(22) Filed: Feb. 7, 2002

(65) Prior Publication Data

US 2003/0146124 A1 Aug. 7, 2003

(51) Int. Cl.[7] ..... B65D 5/50

(52) U.S. Cl. ..... 206/758; 206/1.5; 206/449; 220/4.21

(58) Field of Search ..... 206/1.5, 449, 454–456, 206/485, 758, 775, 765, 774; 40/722, 724, 725, 766, 780; 211/46; 220/315, 326, 4.21, 4.32

(56) References Cited

U.S. PATENT DOCUMENTS

| | | | | |
|---|---|---|---|---|
| 639,054 | A | | 12/1899 | Jenkinson |
| 2,113,245 | A | | 4/1938 | Thomas |
| 2,564,244 | A | | 8/1951 | Bibler |
| 2,790,542 | A | | 4/1957 | Hillman |
| 2,868,364 | A | | 1/1959 | Helser |
| 3,003,623 | A | | 10/1961 | Paul |
| 3,877,572 | A | | 4/1975 | Wiener, Jr. |
| 4,199,059 | A | | 4/1980 | Maroszek |
| 4,216,858 | A | | 8/1980 | Beauchamp |
| 4,261,461 | A | | 4/1981 | Kizlanskas |
| 4,310,091 | A | | 1/1982 | Hara et al. |
| 4,323,153 | A | | 4/1982 | Courtin |
| 4,687,103 | A | | 8/1987 | Corbett |
| 4,801,016 | A | | 1/1989 | Irrgeher |
| 4,995,508 | A | | 2/1991 | Burley |
| 5,085,758 | A | * | 2/1992 | Guadagno et al. ..... 206/449 |
| 5,325,978 | A | * | 7/1994 | Rabig ..... 206/449 |
| 5,344,015 | A | * | 9/1994 | Carlin et al. ..... 206/449 |
| 6,508,495 | B1 | * | 1/2003 | Riley ..... 220/326 |

* cited by examiner

*Primary Examiner*—Luan K. Bui
(74) *Attorney, Agent, or Firm*—R. Keith Harrison

(57) ABSTRACT

A device which is capable of selectively containing or displaying an article. The article container and display device of the present invention may include a case/stand having first and second case units for removable attachment to each other and containing a display frame which holds the article. The case/stand defines a container configuration when the display frame is contained in the case units and the first case unit removably engages the second case unit. Alternatively, the case/stand defines a display stand configuration when the first case unit and the second case unit are placed in adjacent, semi-facing relationship to each other and the display frame is supported by the case units. A latch mechanism may be provided on one or both of the case units for removably engaging the other case unit.

23 Claims, 4 Drawing Sheets

ARTICLE CONTAINER AND DISPLAY DEVICE

BACKGROUND OF THE INVENTION

Field of the Invention

The present invention relates to devices for displaying pictures and other articles and more particularly, to a device which is capable of selectively containing or displaying an article. The article container and display device of the present invention includes a case/stand having first and second case units for removably engaging each other and containing or supporting a display frame which holds the article. The case/stand defines a container configuration when the display frame is contained in the case units and the case units are removably attached to each other. Alternatively, the case/stand defines a display stand configuration when the case units are placed in adjacent, semi-facing relationship to each other and the display frame is supported by the case units. A latch mechanism may be provided on one or both of the case units for removably engaging the other case unit.

A variety of devices are known in the art for containing or displaying articles. Patents of interest in this regard include U.S. Pat. Nos. 639,054; 2,113,245; 2,564,244; 2,790,542; 2,868,364; 3,003,623; 3,877,572; 4,199,059; 4,216,858; 4,261,461; 4,310,091; 4,323,153; 4,687,103; 4,801,016; and 4,995,508.

An object of the present invention is to provide an article container and display device which is capable of selectively containing or displaying an article.

Another object of the present invention is to provide an article container which may be constructed of any of a variety of materials.

Still another object of the present invention is to provide an article container which may be constructed in any size for containing or displaying an article.

Yet another object of the present invention is to provide an article container and display device including a pair of case units which are capable of defining a container configuration for containing an article or defining a display stand configuration for supporting the article in a display configuration.

SUMMARY OF THE INVENTION

These and other objects of the invention are provided in a device which is capable of selectively containing or displaying an article. The article container and display device of the present invention may include a case/stand having first and second case units for removable attachment to each other and containing a display frame which holds the article. The case/stand defines a container configuration when the display frame is contained in the case units and the first case unit removably engages the second case unit. Alternatively, the case/stand defines a display stand configuration when the first case unit and the second case unit are placed in adjacent, semi-facing relationship to each other and the display frame is supported by the case units. A latch mechanism may be provided on one or both of the case units for removably engaging the other case unit.

BRIEF DESCRIPTION OF THE DRAWINGS

The present invention will better be understood, by way of example, with reference to the accompanying drawings, wherein.

DESCRIPTION OF THE EMBODIMENTS

As used herein, the term, "case unit" refers to any enclosure, box, case, or container of any shape or material which is capable of at least partially containing an object. The term, "display frame" refers to any enclosure, box, container, frame, structure, mold or support of any shape, design and material capable of holding and displaying an article. The term, "attachment mechanism" refers to hooks, snaps, loop-pile fasteners, magnets, latches, adhesives, or any other agent capable of removably attaching a first element to a second element. The term, "latch mechanism" refers to hooks, snaps, loop-pile fasteners, magnets, adhesives, or any other agent capable of removably attaching a first case unit to a second case unit.

Figure 1:
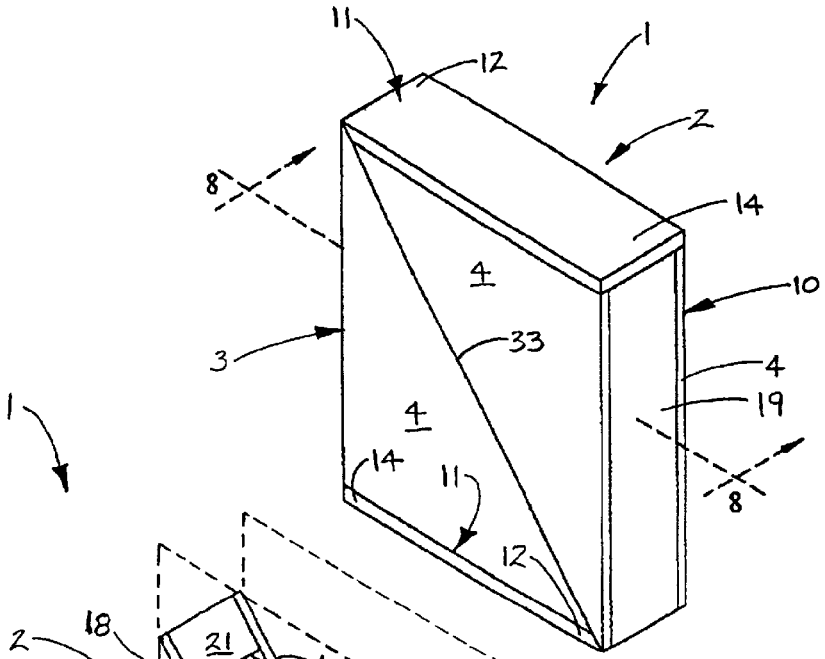
FIG. 1 is a perspective view of an illustrative embodiment of the device of the present invention, with the device disposed in an article-containing configuration.
Figure 2:
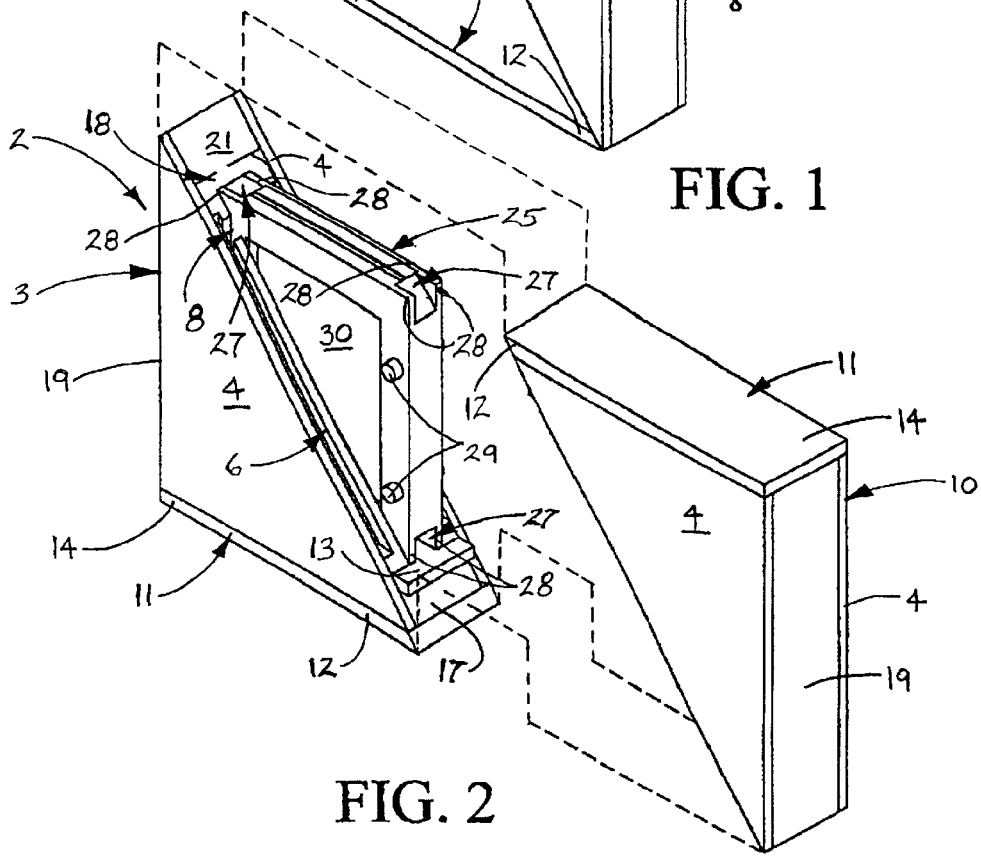
FIG. 2 is a perspective view of the device illustrated in FIG. 1, with one of the case units removed from the other case unit to expose an article and article display frame contained inside the device.
Figures 5, 6, 7:
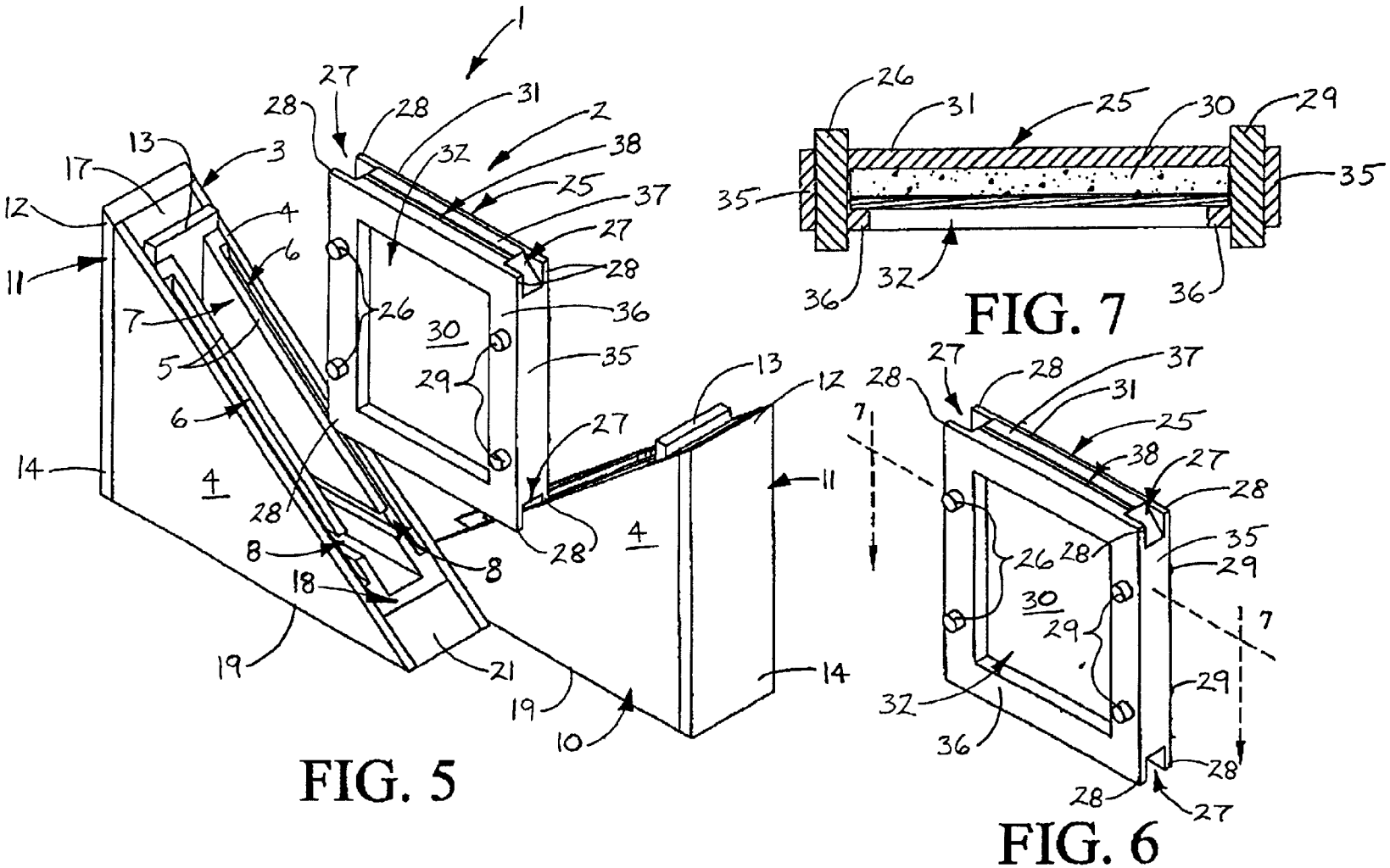
FIG. 5 is a perspective view of the device, with the device disposed in a stand or display configuration for supporting the article-containing display frame.
FIG. 6 is a perspective view of an illustrative display frame element of the device of the present invention.
FIG. 7 is a sectional view, taken along section lines 7—7 in FIG. 6, of the article-containing display frame.
Figure 8:
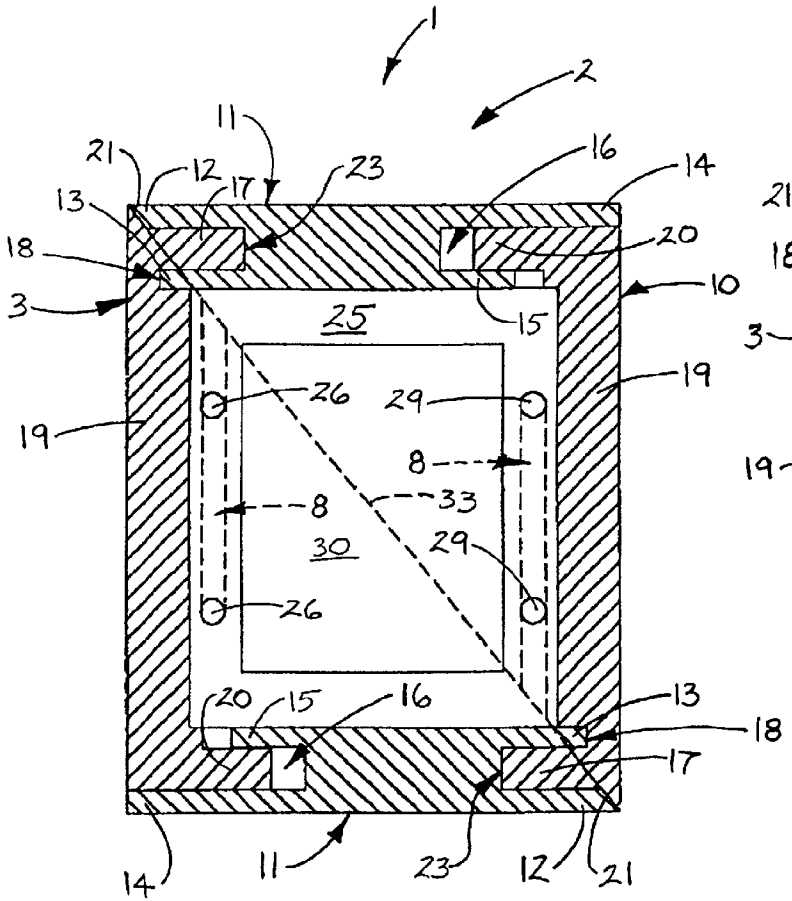
FIG. 8 is a sectional view, taken along section lines 8—8 in FIG. 1, of an illustrative embodiment of the article container and display frame of the present invention, with the case units of the device removably attached to each other to define the article-containing configuration.

Referring to the drawings, the article container and display device, hereinafter referred to as the device, of the present invention is generally indicated by reference numeral 1. The device 1 includes a case/stand 2 having a receiving case unit 3 and a similar, enclosing case unit 10 which are capable of removable attachment to each other to selectively define a container configuration of the case/stand 2 as illustrated in FIG. 1, in which container configuration the case/stand 2 is capable of containing a display frame 25 holding an article 30, as illustrated in FIG. 2. Alternatively, the receiving case unit 3 and enclosing case unit 10 are capable of being detached from each other and positioned in adjacent, semi-facing relationship to each other for supporting the display frame 25 and displaying the article 30 thereon, as illustrated in FIG. 5. As particularly illustrated in FIGS. 3–5, the receiving case unit 3 and the enclosing case unit 10 each includes a pair of typically triangular outer panels 4, joined by a bottom panel 19 along one leg of the triangular outer panels 4. An elongated latch 11 is slidably mounted along the other leg of the outer panels 4. As particularly illustrated in FIG. 8, one end of the latch 11 typically includes a tapered flange 12 which extends in spaced-apart, parallel relationship to a latch tongue 13. A beveled latch block 17 is provided in the space between the tapered flange 12 and the latch tongue 13, and spans the outer panels 4 in fixed relationship thereto. At the opposite end of the latch 11, an outer attachment flange 14 and a parallel, inner attachment flange 15 define an intervening slide gap 16. The slide gap 16 slidably receives a stationary bottom panel attachment flange 20 that extends perpendicularly from one end of the bottom panel 19. The opposite end of the bottom panel 19 includes a beveled latch surface 21 which defines a latch space 18, as particularly illustrated in FIG. 9, and abuts against the complementary beveled surface of the latch block 17. Accordingly, each latch 11 is capable of sliding between the latching position illustrated in FIG. 8, in which the latch space 18 of each case unit 3, 10 receives the latch tongue 13 of the other case unit 3, 10, typically in a friction-fit, and the slide gap 16 is defined between the latch 11 and the bottom panel attachment flange 20 of the corresponding case unit 3, 10; and the unlatching position illustrated in FIG. 9, in which the latch tongue 13 of each case unit 3, 10 slidably disengages the latch space 18 of the opposite case unit 3, 10; the slide gap 16 is closed by the bottom panel attachment flange 20 and the latch 11; and a latch block space 23 is defined between the latch 11 and the latch block 17. In the foregoing manner, the receiving case unit 3 is removably attached to the enclosing case unit 10 to define the container configuration of the case/stand 2 illustrated in FIG. 1 by typically friction-fitting each latch tongue 13 in the latch space 18 of the opposite case unit 3, 10, as illustrated in FIG. 8, and the receiving case unit 3 is detached from the enclosing space unit 10 by sliding each latch 11 to the unlatching position illustrated in FIG. 9. When the case/stand 2 is disposed in the container configuration illustrated in FIG. 1, a match line 33 is defined between the receiving case unit 3 and the enclosing case unit 10.

Figure 3:
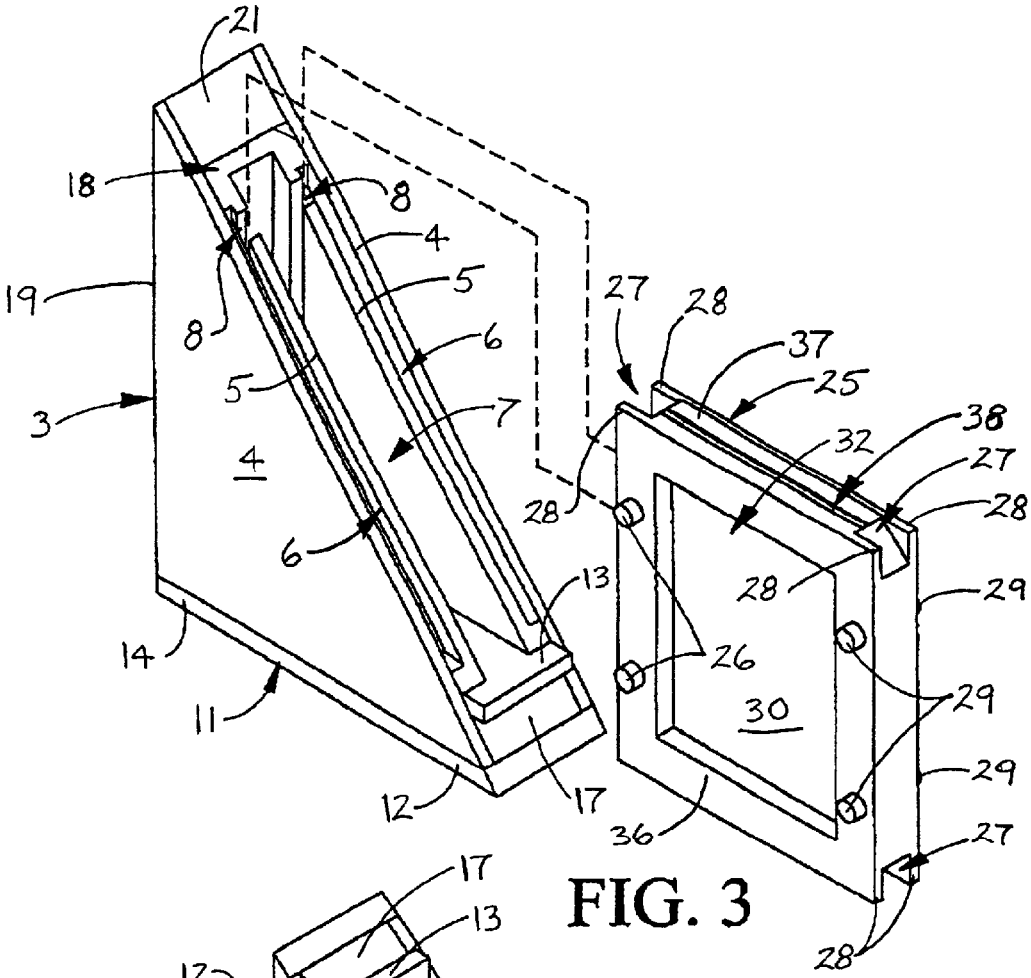
FIG. 3 is a perspective view of one of the case units of the device, illustrating typical placement of the display frame element into the case unit of the device and removal of the display frame from the case unit.
Figure 4:
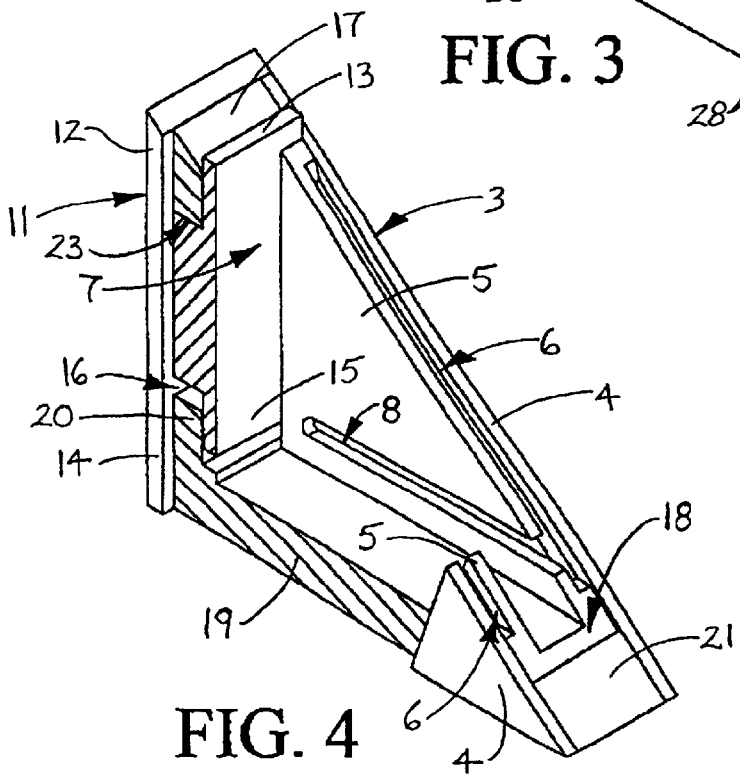
FIG. 4 is a perspective view, partially in section, of a case unit of the device, more particularly illustrating interior components of the case unit.

As further illustrated in FIGS. 3–5, the receiving case unit 3 and the enclosing case unit 10 each further includes a pair of typically triangular inner panels 5 which are disposed in spaced-apart relationship to the respective outer panels 4 to define respective parallel frame support channels 6. As illustrated in FIG. 4, a case unit interior 7 is defined by the inner panels 5 (only one of which is illustrated in FIG. 4), the latch 11 and the bottom panel 19. In one embodiment of the invention, a pair of elongated, registering pin channels 8 extends through the respective inner panels 5, in communication with the case unit interior 7 for purposes which will be hereinafter described.

As illustrated in FIGS. 6 and 7, the device 1 further includes a display frame 25 which may be rectangular, as illustrated, or circular, triangular, octagonal or any other desired shape. The display frame 25 typically includes a rear panel 31 and a front panel 36 which are joined by a pair of side panels 35, a bottom panel (not illustrated) and a top panel 37. A display opening 32 is provided in the front panel 36, and an insertion slot 38 may be included in the top panel 37 to facilitate inserting an article 30, such as a photograph, in the display frame 25 for display of the article 30 through the display opening 32. The display frame 25 may include a transparent, glass or plastic cover (not illustrated) for covering the display opening 32, or the display opening may be uncovered. As illustrated in FIG. 7, in one embodiment of the invention, a first pair of spaced-apart stabilizing pins 26 extends through the rear panel 31 and the front panel 36 on one side of the display opening 32 for traversing the opposing frame support channels 6 of the receiving case unit 3, and a second pair of spaced-apart stabilizing pins 29 in like manner extends through the rear panel 31 and the front panel 36 on the other side of the display opening 32 for traversing the opposing frame support channels 6 of the enclosing case unit 10, as hereinafter described. An attachment notch 27 is provided in both of the lower corners of the display frame 25, or in both the lower corners and in the upper corners of the display frame 25, as illustrated. Each attachment notch 27 is defined between a pair of adjacent attachment flanges 28, the purpose of which will be hereinafter described.

Referring next to FIG. 5 of the drawings, in typical application the device 1 may be used as a display device for the article 30 contained inside the display frame 25. Accordingly, the case/stand 2 is set up to define the display configuration by initially positioning the receiving case unit 3 and the enclosing case unit 10 in adjacent, semi-facing relationship to each other, as illustrated, with the bottom panel 19 of each case unit 2, 10 resting on a supporting surface (not illustrated). Next, the display frame 25 is removably mounted on the receiving case unit 3 and the enclosing case unit 10 by inserting the adjacent outer panels 4 of the respective case units 3, 10 in the respective attachment notches 27 at the bottom corners of the display frame 25, with an attachment flange 28 at each bottom corner of the display frame 25 typically friction-fitted in a frame support channel 6 of the corresponding case unit 3, 10. Accordingly, the article 30 is positioned for display through the display opening 32, in an upward-standing position in the display frame 25. It will be appreciated by those skilled in the art that the display frame 25 may be supported in a straight vertical configuration on the receiving case unit 3 and the enclosing case unit 10, as illustrated, or tilted at any angle thereon, as desired.

Figure 9:
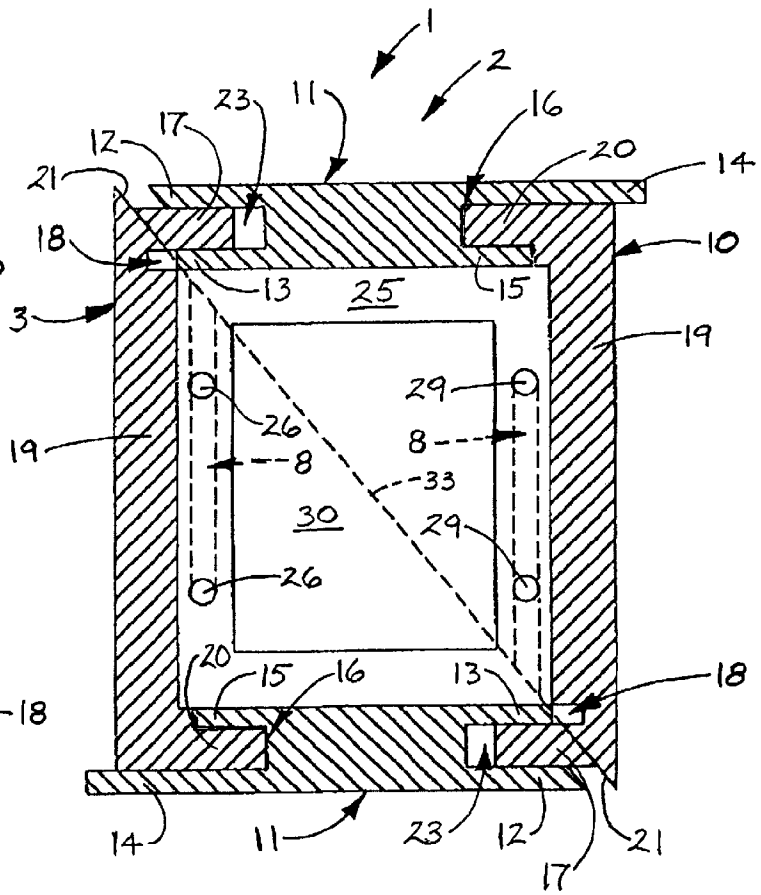
FIG. 9 is a sectional view, taken along section lines 8—8 in FIG. 1, with the latch element of each case unit disengaging the opposite case unit for separation of the case units from each other.

Referring next to FIGS. 1–3, 8 and 9 of the drawings, the case/stand 2 may be disassembled from the display configuration of FIG. 5 to define the container configuration of FIG. 1 in order to facilitate storing or carrying the display frame 25 inside the case/stand 2. Accordingly, the display frame 25 is removed from the display position of FIG. 5 and initially inserted in the case unit interior 7 of the receiving case unit 3, as illustrated in FIG. 3. This is accomplished typically by slidably inserting the first pair of stabilizing pins 26 in the respective pin channels 8 of the receiving case unit 3 as the display frame 25 is inserted into the case unit interior 7. As illustrated in FIG. 2, the enclosing case unit 10, inverted with respect to the receiving case unit 3, is next lowered over the exposed display frame 25 in such a manner that the second pair of stabilizing pins 29 of the display frame 25 is typically slidably inserted in the pin channels 8 of the enclosing case unit 10, as illustrated in FIG. 9, as the case unit interior 7 of the enclosing case unit 10 receives the remaining exposed triangular half of the display frame 25. Finally, the latches 11 of the respective case units 3, 10 are slided from the unlatching position of FIG. 9 to the latching position of FIG. 8, as heretofore described, to removably attach the enclosing case unit 10 to the receiving case unit 3. The display frame 25 can subsequently be removed from the case/stand 2 for display of the article 30 in the manner heretofore described with respect to FIG. 5, as desired, by detaching the enclosing case unit 10 from the receiving case unit 3 by sliding the latches 11 from the latching configuration of FIG. 8 to the unlatch configuration of FIG. 9, separating the enclosing case unit 10 from the receiving case unit 3, and removing the display frame 25 from the case unit interior 7 of the receiving case unit 3.

Because the receiving case unit 3 and the enclosing case unit 10 may be substantially identical in construction, it is understood that the functions of the receiving case unit 3 and the enclosing case unit 10 in the method of placing the display frame 25 inside the case/stand 2, as heretofore described, may be reversed. Accordingly, the enclosing case unit 10 may initially receive the display frame 25 in the manner heretofore described with respect to the receiving case unit 3 in FIG. 2, in which case the receiving case unit 3 would then be attached to the enclosing case unit 10 in the manner heretofore described with respect to the enclosing case unit 10 in FIG. 2. It is further understood that the receiving case unit 3, the enclosing case unit 10 and the display frame 25 may be constructed of wood, plastic, metal or any other suitable material. Instead of or in addition to the insertion slot 38, the display frame 25 may be constructed with the front panel 36 hingedly attached to the rear panel 31 to facilitate placement of the article 30 into the display frame 25 and removal of the article 30 from the display fame 25, as desired. It is further understood that the display frame 25 may be adapted to hold any of a variety of articles 30, including a flat-screen computer monitor, in non-exclusive particular.

Referring again to FIGS. 8 and 9, it is understood that a spring (not illustrated) may be interposed between the bottom panel attachment flange 20 and the latch 11 inside the slide gap 16 to normally bias the latch 11 in the latching configuration of FIG. 8. In that case, the springs would be compressed between the bottom panel attachment flange 20 and the latch 11 upon detaching the receiving case unit 3 from the enclosing case unit 10, as illustrated in FIG. 9, and would automatically return the latches 11 to the latching position of FIG. 8 upon release.

It is understood that any type of fastener or latch mechanism known in the art, including hooks, snaps, loop-pile fasteners, magnets, or adhesives, in non-exclusive particular, may be used in addition to or instead of the latches 11 to removably attach the receiving case unit 3 to the enclosing case unit 10. Furthermore, it is understood that the case units 3, 10 are not limited to a triangular shape, as heretofore described and illustrated in the drawings, but may be circular, square, octagonal or any other desired shape to form a case/stand 2 having a container shape which is the shape of the combined case units. It is further understood that any type of attachment mechanism known in the art, including hooks, snaps, loop-pile fasteners, magnets, latches or adhesives, in non-exclusive particular, may be used in addition to or instead of the attachment flanges 28 and attachment notches 27 to removably attach the display frame 25 to the case units 3, 10.

While the preferred embodiments of the invention have been described it will be recognized and understood that various modifications can be made in the invention and the appended claims are intended to cover all such modifications which may fall within the spirit and scope of the invention Having described my invention with the particularity set forth above, I claim:

1. An article container and display device for selectively containing and displaying an article, said device comprising a case/stand comprising:

a first case unit;

a second case unit for removably engaging said first case unit;

a display frame for holding the article;

a first attachment mechanism provided on said display frame for removably engaging said first case unit and a second attachment mechanism provided on said display frame for removably engaging said second case unit;

wherein said case/stand defines a container configuration when said first case unit removably engages said second case unit and said display frame is contained in said first case unit and said second case unit;

wherein said case/stand defines a display stand configuration when said first case unit and said second case unit are placed in adjacent relationship to each other and said first attachment mechanism engages said first case unit and said second attachment mechanism engages said second case unit; and a latch mechanism provided on said first case unit and said second case unit for removably attaching said first case unit to said second case unit; and wherein said first attachment mechanism comprises a first pair of attachment flanges and said second attachment mechanism comprises a second pair of attachment flanges.

2. An article container and display device for selectively containing and displaying an article, said device comprising a case/stand comprising:

a first case unit;

a second case unit for removably engaging said first case unit;

a display frame for holding the article;

a first attachment mechanism provided on said display frame for removably engaging said first case unit and a second attachment mechanism provided on said display frame for removably engaging said second case unit;

wherein said case/stand defines a container configuration for concealing the article when said first case unit removably engages said second case unit and said display frame is contained in and enclosed by said first case unit and said second case unit;

wherein said case/stand defines a display stand configuration for displaying the article when said first case unit and said second case unit are disengaged from each other and placed in adjacent relationship to each other and said first attachment mechanism engages said first case unit and said second attachment mechanism engages said second case unit; and a latch mechanism provided on said first case unit and said second case unit for removably attaching said first case unit to said second case unit.

3. The device of claim 2 wherein said latch mechanism comprises a latch tongue provided on said first case unit and a latch tongue groove provided in said second case unit for removably receiving said latch tongue.

4. The device of claim 3 wherein said first attachment mechanism comprises a first pair of attachment flanges and said second attachment mechanism comprises a second pair of attachment flanges.

5. The device of claim 2 comprising at least one first unit pin channel provided in said first case unit, at least one second unit pin channel provided in said second case unit, and at least one first unit stabilizing pin and at least one second unit stabilizing pin provided on said display frame; and wherein said at least one first unit pin channel slidably receives said at least one first unit stabilizing pin and said at least one second unit pin channel slidably receives said at least one second unit stabilizing pin when said case/stand defines said container configuration.

6. The device of claim 5 wherein said first attachment mechanism comprises a first pair of attachment flanges and said second attachment mechanism comprises a second pair of attachment flanges.

7. The device of claim 5 wherein said latch mechanism comprises a latch tongue provided on said first case unit and a latch tongue groove provided in said second case unit for removably receiving said latch tongue.

8. The device of claim 7 wherein said first attachment mechanism comprises a first pair of attachment flanges and said second attachment mechanism comprises a second pair of attachment flanges.

9. The device of claim 2 wherein said latch mechanism comprises a first unit latch tongue provided on said first case unit, a second unit latch tongue groove provided in said second case unit for removably receiving said first unit latch tongue, a second unit latch tongue provided on said second case unit, and a first unit latch tongue groove provided in said first case unit for removably receiving said second unit latch tongue.

10. The device of claim 9 wherein said first attachment mechanism comprises a first pair of attachment flanges and said second attachment mechanism comprises a second pair of attachment flanges.

11. The device of claim 9 comprising at least one first unit pin channel provided in said first case unit, at least one second unit pin channel provided in said second case unit, and at least one first unit stabilizing pin and at least one second unit stabilizing pin provided on said display frame; and wherein said at least one first unit pin channel slidably receives said at least one first unit stabilizing pin and said at least one second unit pin channel slidably receives said at least one second unit stabilizing pin when said case/stand defines said container configuration.

12. The device of claim 11 wherein said first attachment mechanism comprises a first pair of attachment flanges and said second attachment mechanism comprises a second pair of attachment flanges.

13. An article container and display device for selectively containing and displaying an article, said device comprising a case/stand comprising:

a first case unit comprising a first case unit interior and a pair of first unit pin channels provided in communication with said first case unit interior;

a second case unit for removably engaging said first case unit, said second case unit comprising a second case unit interior and a pair of second unit pin channels provided in communication with said second case unit interior;

a display frame for holding the article, said display frame comprising a plurality of first unit stabilizing pins and a plurality of second unit stabilizing pins;

a first attachment mechanism provided on said display frame for removably engaging said first case unit and a second attachment mechanism provided on said display frame for removably engaging said second case unit;

wherein said case/stand defines a container configuration when said pair of first unit pin channels slidably receives said plurality of first unit stabilizing pins, respectively, said pair of second unit pin channels slidably receives said plurality of second unit stabilizing pins, respectively, said first case unit removably engages said second case unit, and said display frame is contained in said first case unit interior and said second case unit interior;

wherein said case/stand defines a display stand configuration when said first case unit and said second case unit are placed in adjacent relationship to each other and said first attachment mechanism engages said first case unit and said second attachment mechanism engages said second case unit; and a latch mechanism provided on said first case unit and said second case unit for removably attaching said first case unit to said second case unit.

14. The device of claim 13 wherein said first attachment mechanism comprises a first pair of attachment flanges and said second attachment mechanism comprises a second pair of attachment flanges.

15. The device of claim 13 wherein said latch mechanism comprises a latch tongue provided on said first case unit and a latch tongue groove provided in said second case unit for removably receiving said latch tongue.

16. The device of claim 15 wherein said first attachment mechanism comprises a first pair of attachment flanges and said second attachment mechanism comprises a second pair of attachment flanges.

17. The device of claim 13 wherein said latch mechanism comprises a first unit latch tongue provided on said first case unit, a second unit latch tongue groove provided in said second case unit for removably receiving said first unit latch tongue, a second unit latch tongue provided on said second case unit, and a first unit latch tongue groove provided in said first case unit for removably receiving said second unit latch tongue.

18. The device of claim 17 wherein said first attachment mechanism comprises a first pair of attachment flanges and said second attachment mechanism comprises a second pair of attachment flanges.

19. An article container and display device for selectively containing and displaying an article, said device comprising a case/stand comprising:

a first case unit comprising a first case unit interior and at least one first unit frame support channel;

a second case unit for removably engaging said first case unit, said second case unit comprising a second case unit interior and at least one second unit frame support channel;

a display frame for holding the article, said display frame comprising a pair of first unit attachment flanges and a pair of second unit attachment flanges;

wherein said case/stand defines a container configuration when said first case unit removably engages said second case unit and said display frame is contained in said first case unit interior and said second case unit interior;

wherein said case/stand defines a display stand configuration when said first case unit and said second case unit are placed in adjacent relationship to each other and said pair of first unit attachment flanges engages said first case unit at said at least one first unit frame support channel and said pair of second unit attachment flanges engages said second case unit at said at least one second unit frame support channel; and a latch mechanism provided on said first case unit and said second case unit for removably attaching said first case unit to said second case unit.

20. The device of claim 19 comprising at least one first unit pin channel provided in said first case unit in communication with said first case unit interior, at least one second unit pin channel provided in said second case unit in communication with said second case unit interior, and at least one first unit stabilizing pin and at least one second unit stabilizing pin provided on said display frame; and wherein said at least one first unit pin channel slidably receives said at least one first unit stabilizing pin and said at least one second unit pin channel slidably receives said at least one second unit stabilizing pin when said case/stand defines said container configuration.

21. The device of claim 19 wherein said latch mechanism comprises a first unit latch tongue provided on said first case unit, a second unit latch tongue groove provided in said second case unit for removably receiving said first unit latch tongue, a second unit latch tongue provided on said second case unit, and a first unit latch tongue groove provided in said first case unit for removably receiving said second unit latch tongue.

22. The device of claim 21 comprising at least one first unit pin channel provided in said first case unit in communication with said first case unit interior, at least one second unit pin channel provided in said second case unit in communication with said second case unit interior, and at least one first unit stabilizing pin and at least one second unit stabilizing pin provided on said display frame; and wherein said at least one first unit pin channel slidably receives said at least one first unit stabilizing pin and said at least one second unit pin channel slidably receives said at least one second unit stabilizing pin when said case/stand defines said container configuration.

23. An article container and display device for selectively containing and displaying an article, said device comprising a case/stand comprising:

a first case unit;

a second case unit for removably engaging said first case unit;

a display frame for holding the article;

a first attachment mechanism provided on said display frame for removably engaging said first case unit and a second attachment mechanism provided on said display frame for removably engaging said second case unit;

wherein said case/stand defines a container configuration for concealing the article when said first case unit removably engages said second case unit and said display frame is contained in and enclosed by said first case unit and said second case unit;

wherein said case/stand defines a display stand configuration for displaying the article when said first case unit and said second case unit are disengaged from each other and placed in adjacent relationship to each other and said first attachment mechanism engages said first case unit and said second attachment mechanism engages said second case unit;

a first latch slidably carried by said first case unit for removably engaging said second case unit; and a second latch slidably carried by said second case unit for removably engaging said first case unit.

* * * * *